US005937669A

United States Patent [19]

Okuri

[11] Patent Number: 5,937,669

[45] Date of Patent: Aug. 17, 1999

[54] HEAT PUMP TYPE AIR CONDITIONER

[75] Inventor: Yoriyuki Okuri, Suita, Japan

[73] Assignees: Kodensha Co., Ltd., Osaka; Yugen Kaisha Green Earth Kansai, Toyonaka, both of Japan; part interest to each

[21] Appl. No.: 09/097,737

[22] Filed: Jun. 16, 1998

[51] Int. Cl.[6] ..... F25B 15/10

[52] U.S. Cl. ..... 62/324.1; 62/324.6; 62/114

[58] Field of Search ..... 62/324.1, 324.6, 62/114

[56] References Cited

U.S. PATENT DOCUMENTS

| | | | |
|---|---|---|---|
| 4,563,879 | 1/1986 | Hama et al. | 62/160 |
| 4,646,538 | 3/1987 | Blackshaw et al. | 62/238.7 |
| 4,862,705 | 9/1989 | Nakamura et al. | 62/324.6 |
| 5,548,971 | 8/1996 | Rockenfeller et al. | 62/324.2 |
| 5,674,412 | 10/1997 | Byrne et al. | 62/84 |
| 5,709,090 | 1/1998 | Endo et al. | 62/81 |
| 5,768,902 | 6/1998 | Nonaka et al. | 62/183 |

FOREIGN PATENT DOCUMENTS

| | | |
|---|---|---|
| 9-79673 | 3/1987 | Japan . |
| 7-301463 | 11/1995 | Japan . |
| 8-49948 | 2/1996 | Japan . |

*Primary Examiner*—Henry Bennett
*Assistant Examiner*—Mark Shulman
*Attorney, Agent, or Firm*—Wenderoth, Lind & Ponack, L.L.P.

[57] ABSTRACT

A heat pump type cooling/heating air conditioner which can be operated using a new substitute refrigerant gas HFC (hydrofluorocarbon) in combination with a mineral lubricating oil. This air conditioner includes a compressor, a condenser and an evaporator. The compressor and the condenser are connected together by a gas pipe having a four-way valve. The condenser is provided at its outlet with capillary tubes connected to an additional condenser by a gas pipe. The additional condenser is connected to capillary tubes of the evaporator by a gas pipe. The gas outlet of the evaporator and the compressor are connected together by a gas pipe in which is disposed the four-way valve. Thus, cooling and heating operations can be changed over.

14 Claims, 2 Drawing Sheets

HEAT PUMP TYPE AIR CONDITIONER

BACKGROUND OF THE INVENTION

The present invention relates to a heat pump type air conditioner in which a heat pump is operated using singly or in combination a new substitute refrigerant gas HFC (hydrofluorocarbon) 134a or HFC125, which, containing no chlorine, will not damage the ozone layer, and is nonflammable and nonpoisonous, and in which the flow of the refrigerant gas is reversible by changing over the flow passage of gas for cooling and heating.

To protect the ozone layer, use of chlorine-containing freons, notorious ozone layer killers, has to be totally stopped on the face of the earth as soon as possible. But simply replacing such freons as refrigerants with new ones will make the operation of air conditioners difficult.

Newly developed substitute refrigerant gases HFC134a and HFC125 contain no chlorine and will not damage the precious ozone layer. But these gases have a problem in that they are not compatible with an ordinary mineral lubricating oil and thus such gases have to be used in combination with a specially developed lubricating oil to operate existing heat pumps.

Mixing with combustible HFC refrigerant gas and use of ester series lubricating oil compatible with HFC refrigerant gas are being considered, but with no marked development.

I have already proposed a method and apparatus for operating a heat pump using a new substitute refrigerant gas HFC134a or HFC125 or their mixture. The point of our prior invention is to add an extra condenser to an existing condenser. By using two separate condensers, the condensing capacity is increased and mutual solubility between refrigerant gas HFC134a or HFC125 and a mineral lubricating oil improves.

But in the case of a heat pump device used both for cooling and heating, simply by increasing the heat exchange capacity of the condenser, refrigerant gas HFC134a or HFC125 may separate from a mineral lubricating oil due to insufficient liquefaction of refrigerant during heating because during heating, the refrigerant flows in a reverse direction and thus the condensers are used as evaporators and the evaporators as condensers.

One possible solution would be to add, separately or as a one-piece unit, an extra condenser 2' and an extra evaporator 3' to the existing condenser 2 and the evaporator 3, respectively, as shown in FIG. 2 to increase their respective condensing power. But this solution has a problem in that when either the evaporator or condenser is used as an evaporator, its heat absorbing capacity tends to be so large that the refrigerant loses its cooling capacity by the time it leaves the evaporator or the condenser as the evaporator. While the atmospheric temperature is high, the excessively heated refrigerant cannot cool the compressor.

The compressor is generally cooled by the refrigerant returned, which is gasified but still cool enough to have a sufficient cooling capacity.

An object of the present invention is to provide a heat pump which can increase the heat exchange capacity of either of the evaporator and the condenser whenever it is used as a condenser so that the refrigerant gas is sufficiently liquefied and compatible well in a mineral lubricating oil.

That is, according to the present invention, both during cooling and heating, only either of the condenser and the evaporator that is being used as a condenser is increased, while the other's heat exchange capacity remains unchanged, so that the refrigerant gasified by the evaporator is still cool enough to be able to cool the compressor.

SUMMARY OF THE INVENTION

According to the present invention, there is provided a heat pump type cooling/heating air conditioner using substitute refrigerant gas HFC and comprising a compressor, a condenser, an evaporator and an additional condenser. The compressor and the condenser are connected together by a gas pipe through a four-way valve. The condenser is provided with capillary tubes connected to the additional condenser by a gas pipe. The evaporator is provided with capillary tubes connected to the additional condenser by a gas pipe, and the evaporator and the compressor are connected together by a gas pipe through the four-way valve, thereby changing over cooling and heating operations.

Other features and objects of the present invention will become apparent from the following description made with reference to the accompanying drawings, in which:

DETAILED DESCRIPTION OF THE PREFERRED EMBODIMENTS

First Embodiment

Figure 1:
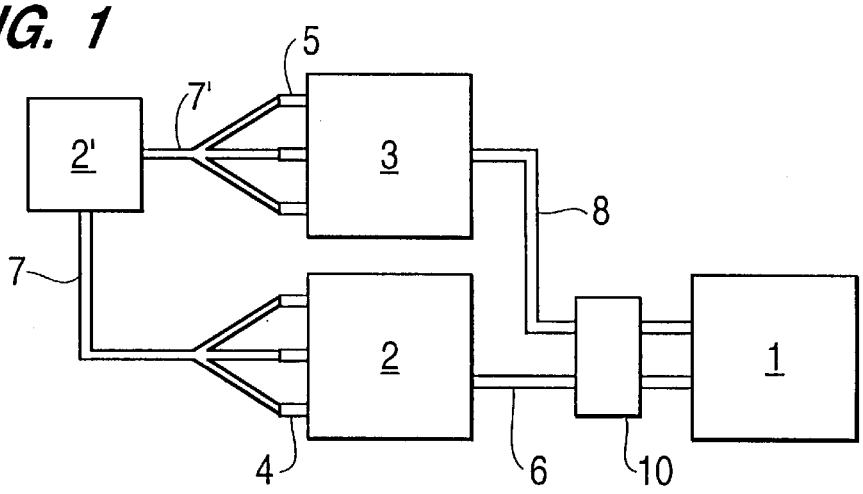
FIG. 1 is a schematic view of a first embodiment of the present invention.

Now referring to FIG. 1, the first embodiment of the present invention, in which is used a new substitute refrigerant gas HFC 134a, is described.

A compressor 1 is connected to a condenser 2 through a gas pipe 6 having a four-way valve 10. Capillary tubes 4 provided at outlets of the condenser 2 are connected to an additional condenser 2' through a gas pipe 7. The additional condenser 2' is in turn connected to capillary tubes 5 of an evaporator 3 through a gas pipe 7'. The evaporator 3 has its gas outlet connected to the compressor 1 through a gas pipe 8 and the four-way valve 10.

For cooling, refrigerant gas discharged from the compressor 1 is distributed into the gas pipe 6 by the four-way valve 10 and then to the condenser 2 where it is condensed. The thus condensed refrigerant gas exits the capillary tubes 4, and flows through the gas pipe 7 into the additional condenser 2'. Preferably, the pipe of the gas pipe circuit in the additional condenser 2' has an inner diameter not exceeding 80%, more preferably not exceeding 70%, of the inner diameter of the gas pipe in the condenser 2 so that the refrigerant can flow through the condenser 2' without being evaporated, i.e. in the form of a liquid. The refrigerant is completely liquefied by being further condensed in the additional condenser 2' and dissolves well with a mineral lubricating oil.

The refrigerant thus mixed with mineral lubricating oil flows through the gas pipe 7' into the evaporator 3 after being depressurized in the capillary tubes 5.

For efficient evaporation of the refrigerant, the pipe of the gas pipe circuit in the evaporator 3 has a greater diameter than the pipe of the gas pipe circuit in the additional condenser 2'.

The refrigerant that has absorbed heat by evaporation flows through the gas pipe 8 and the four-way valve 10 back into the compressor 1.

Since the air conditioner of the present invention has the two condensers 2 and 2' and a single evaporator 3, the heat exchange capacity of the condensers 2 and 2' is increased but the heat exchange capacity of the evaporator 3 remains the same as before, so that the gasified refrigerant is kept at a low temperature when it flows back into the compressor 1. The compressor 1 is thus cooled.

For heating, the flow of refrigerant gas is reversed by the four-way valve 10. That is, refrigerant gas discharged from the compressor 1 is directed to the evaporator 3 through the gas pipe 8. In this case, the evaporator 3 serves as a condenser. That is, the refrigerant gas is condensed by the evaporator 3 to release heat, thus heating the room.

The refrigerant condensed in the evaporator 3 flows through the capillary tubes 5 and the gas pipe 7' into the additional condenser 2'. Since the pipe diameter of the gas pipe circuit in the additional condenser 2' is 80% or sometimes 70% or less of the pipe diameter of the gas pipe circuit in the condenser 2, the refrigerant passes through the condenser 2' in a liquid form, i.e. without being evaporated. Rather, the refrigerant is further condensed in the condenser 2' and completely liquefied and thus dissolves well with a mineral lubricating oil.

The refrigerant thus mixed with mineral lubricating oil flows through the gas pipe 7 into the condenser 2 after being depressurized in the capillary tubes 4 and is evaporated in the condenser 2, which serves as an evaporator in this case.

For efficient evaporation of the refrigerant, the gas pipe circuit in the condenser 2 has a greater pipe diameter than the gas pipe circuit in the additional condenser 2'.

After having absorbed heat by evaporation, the refrigerant flows through gas pipe 6 and the four-way valve 10 back into the compressor 1.

During heating, the evaporator 3 and the additional condenser 2' serve as condensers, so that the heat exchange capacity of these two condensers is increased but the heat exchange capacity of the condenser 2 working as a single evaporator is not. Thus, the gasified refrigerant is kept at a low temperature when it flows back into the compressor 1. The compressor 1 is thus cooled.

Thus, both during cooling while the refrigerant gas is condensed in the condenser 2 and evaporated in the evaporator 3, and during heating while the refrigerant gas is condensed in the evaporator 3 and evaporated in the condenser 2, the additional condenser 2' always works as a condenser. The condenser 2' thus completely liquefies the refrigerant gas, allowing the refrigerant to dissolve well with mineral lubricating oil. In other words, both during cooling and heating, the heat exchange capacity of the condenser means is always kept at a high level while the heat exchange capacity of the evaporator means will not increase.

If the additional condenser 2' has a heat exchange capacity equal to 30% or more of the heat exchange capacity of the condenser 2, refrigerant HFC 134a or HFC125 will dissolve well with mineral lubricating oil. In the case of refrigerant HFC134a, increase by only about 20% may be enough. For refrigerant HFC125, an increase by 30% or more, sometimes 50% or more, may be needed.

If the ordinarily used condenser 2 has a heat exchange capacity of 7500 Kcal/h, an additional condenser 2' having a heat exchange capacity of 2250 Kcal/h or more should be used.

Conventional heat pump type air conditioners include a condenser and an evaporator having substantially the same heat exchange capacity. If HFC134a or HFC125 is used as a refrigerant gas, the heat exchange capacity of the condenser has to be at least 20% and preferably 30% higher than the heat exchange capacity of the evaporator.

During cooling, the refrigerant gas discharged from the compressor 1 flows through the gas pipe 6 into the condenser 2 where it is condensed. The thus condensed refrigerant flows through the capillary tubes 4 into the additional condenser 2'. If the gas pipe circuit in the additional condenser 2' were substantially equal in pipe diameter to that in the condenser 2, the refrigerant might evaporate in the condenser 2'.

To prevent evaporation, the gas pipe in the additional condenser 2' should have a diameter 80–70% or less of the diameter of the gas pipe in the condenser 2. With this arrangement, the refrigerant flows in a liquid form without evaporating. During heat exchange with the atmosphere, the condenser 2' functions as a condenser to further condense the refrigerant.

When the refrigerant is liquefied, its volume decreases. When liquefied, heat exchange to the center of the pipe becomes difficult.

Refrigerant discharged from the compressor 1 flows into the condenser 2 in the form of a complete gas. Thus, the gas pipe in the condenser 2 has to have a sufficiently large diameter. Refrigerant gas is liquefied in the condenser 2 and flows into the additional condenser 2' in the form of a liquid. Even though the gas pipe in the additional condenser 2' is rather small in diameter, refrigerant can smoothly flow through because it is a liquid. Since the pipe in the condenser 2' is small in diameter, sufficient heat exchange to the center of the pipe is possible. For efficient heat exchange, the gas pipe in the additional condenser 2' has a diameter 80% or less, preferably 70% of the diameter of the gas pipe in the condenser 2.

Figure 6:
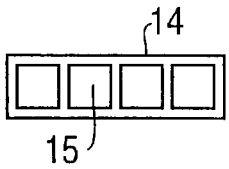
FIG. 6 is a end view of a gas pipe having its interior partitioned into a plurality of cells in order to reduce the sectional area of the gas circuit.

Not only is the gas pipe in the additional condenser 2' smaller in diameter than the gas pipe in the condenser 2, but a heat exchanger (condenser or evaporator) in the form of a gas pipe case 14 having a plurality of gas circuits 15 formed by extrusion molding, as shown in FIG. 6, may be used to reduce the sectional area of each gas circuit and thus to further improve the efficiency of heat exchange. If such a heat exchanger is used, its sectional area has to be 64%–49% or less.

Ordinarily, the additional condenser 2' and the ordinary condenser 2 are put in two separate cases and air is supplied from two separate fans to the respective condensers for heat exchange.

Figure 3:
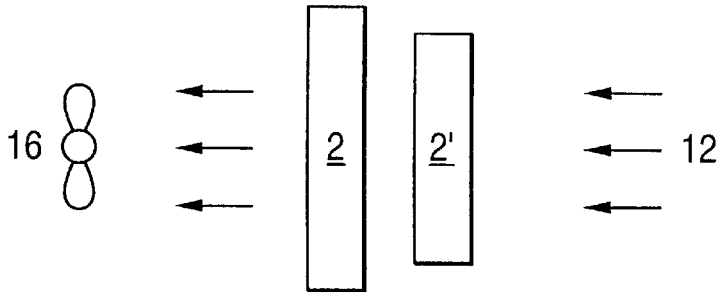
FIG. 3 is a schematic view of an additional condenser 9 added to an existing condenser 2 on its atmospheric air sucking side.

But as shown in FIG. 3, if the condenser 2' is provided in juxtaposition with the ordinary condenser 2 on its air sucking side, no two fans are needed. In this arrangement, air sucked by a single fan 16 first passes through the additional condenser 2' and then through the ordinary condenser 2. In the condenser 2, refrigerant gas is hot and releases a large amount of heat. In the additional condenser 2', refrigerant gas is not hot and thus releases less heat.

In the additional condenser 2', heat exchange is made with air of low temperature whereas in the condenser 2 heat exchange is done with air of higher temperature but lower than refrigerant gas. Thus heat exchange is done sufficiently in both capacitors 2 and 2'.

During heating, the additional condenser 2' releases heat by condensing the refrigerant, while the condenser 2 absorbs heat by evaporating it.

The additional condenser 2', provided outdoors beside the condenser 2, may slightly reduce the heating ability of the air conditioner because it releases heat into the outer air. But instead, the heat released from the condenser 2' is used to heat the condenser 2, thus improving its heat-absorbing capacity. Also it prevents frosting of the condenser 2 as an evaporator, especially in cold winter days.

Second Embodiment

Figure 4:
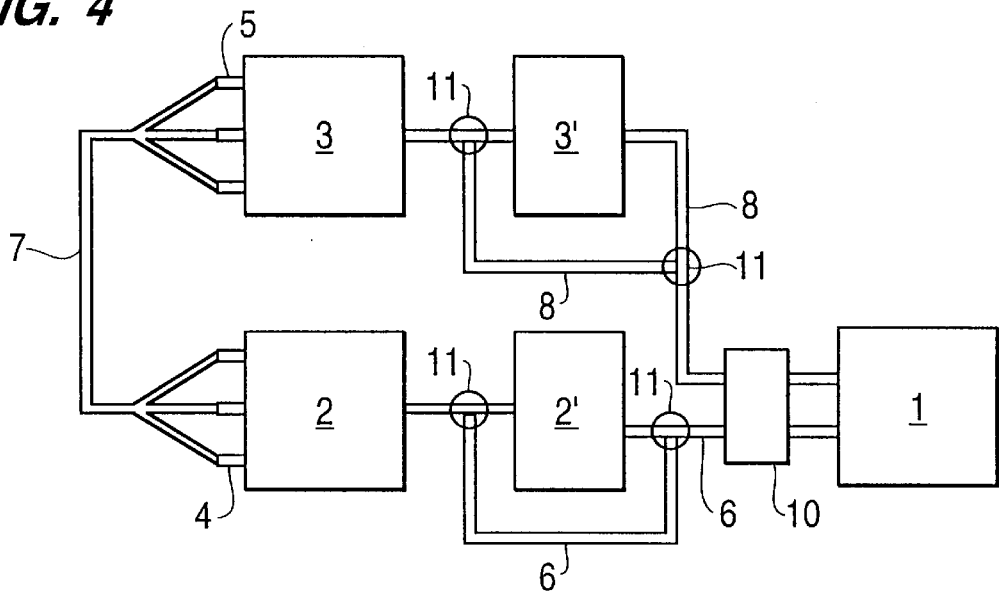
FIG. 4 is a schematic view of a second embodiment of the present invention.

FIG. 4 shows the second embodiment of the present invention, which is a heat pump type air conditioner designed such that the condenser is always higher in heat exchange capacity by 30% or more than the evaporator while it uses a new substitute refrigerant gas HFC134a or HFC125. The same parts are denoted by the same numerals.

As shown, the air conditioner has a primary condenser 2, a secondary condenser 2' having a heat exchange power equal to 30% or more of that of the primary condenser 2, a primary evaporator 3, and a secondary evaporator 3' having a heat exchange power equal to 30% or more of that of the evaporator 3.

During cooling, when the condenser 2 and the evaporator 3 are used as a condenser and an evaporator, respectively, the condenser 2' is activated as a condenser, while the evaporator 3' is deactivated. During heating, when the condenser 2 and the evaporator 3 are used as an evaporator and a condenser, respectively, the evaporator 3' is activated as a condenser, while the condenser 2' is deactivated.

As shown, a compressor 1 is connected to the condenser 2' through a gas pipe 6 having a four-way valve 10. The primary and secondary condensers 2 and 2' are connected together by a gas pipe 6.

The primary condenser 2 has capillary tubes 4 connected to capillary tubes 5 of the primary evaporator 3 by a gas pipe 7. The refrigerant gas flow rate through the gas pipe 7 is substantially equal to the gas flow rate through the capillary tubes 4 or 5.

The evaporators 3 and 3' are connected together by a gas pipe 8, while the evaporator 3' and the compressor 1 are connected together by a gas pipe 8 in which is interposed the four-way valve 10.

The gas pipe 8 has a main line that extends through the evaporator 3' and a branch line that bypasses the evaporator 3'. Changeover valves 11 are provided at the connecting points between the main and branch lines for selectively directing the refrigerant through the main line or branch line.

A similar branch line that bypasses the condenser 2' may be provided. But this will not be necessary if the air conditioner is intended to be used for heating only during winter seasons.

In this embodiment, during cooling, refrigerant gas discharged from the compressor 1 flows through the gas pipe 6 having the four-way valve 10 into the condenser 2', where it releases heat, and then into the condenser 2, where it releases heat again and is completely liquefied.

The now completely liquefied refrigerant flows through the capillary tubes 4 of the condenser 2 and the gas pipe 7. Since the gas flow rate through the gas pipe 7 is substantially equal to the flow rate through the capillary tubes 4, the liquefied gas flows through the pipe 7 pipe into the capillary tubes 5 of the evaporator 3 without being gasified. When it passes the capillary tubes 5, the refrigerant is depressurized.

Since the gas circuit in the evaporator 3 has a large sectional area, the refrigerant gas is sufficiently gasified to absorb heat.

Since the main line of the gas pipe 8 is closed in this state, refrigerant flows through the branch line, while bypassing the evaporator 3', back into the compressor 1.

For heating, the four-way valve 10 is changed over to direct the refrigerant gas discharged from the compressor 1 into the evaporator 3' through the gas pipe 8, and then into the evaporator 3 for heat exchange.

In this case, the evaporators 3 and 3' are used as condensers. The added heat exchange power provided by the evaporator 3' makes it possible to completely liquefy the refrigerant by the time it leaves the evaporator 3. Since the gas flow rate through the gas pipe 7 is substantially equal to the flow rate through the capillary tubes 5, the liquefied gas flows through the pipe 7 pipe into the capillary tubes 4 of the condenser 2 without being gasified. In capillary tubes 4, the refrigerant is depressurized.

Since the gas circuit in the condenser 2 has a large sectional area, the refrigerant gas is sufficiently gasified to absorb heat.

When the atmospheric temperature is high, the line bypassing the condenser 2' is used. When it is low, the refrigerant gas is directed into the condenser 2'. Although the refrigerant gas may be heated by absorbing heat in the condenser, this will pose no problem as long as the ambient temperature is not high.

Third Embodiment

Figure 2:
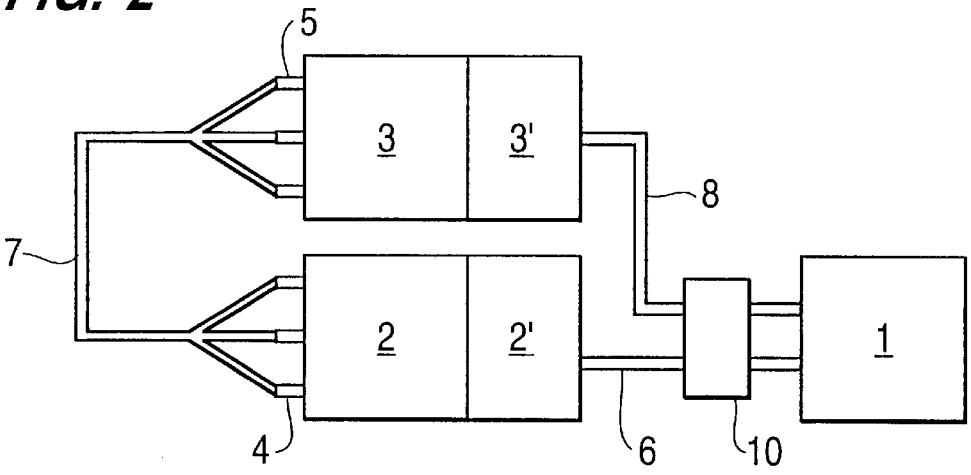
FIG. 2 is a schematic view of a conventional heat pump type cooling/heating air conditioner to which are added an extra condenser 2' and an extra evaporator 3'.
Figure 5:
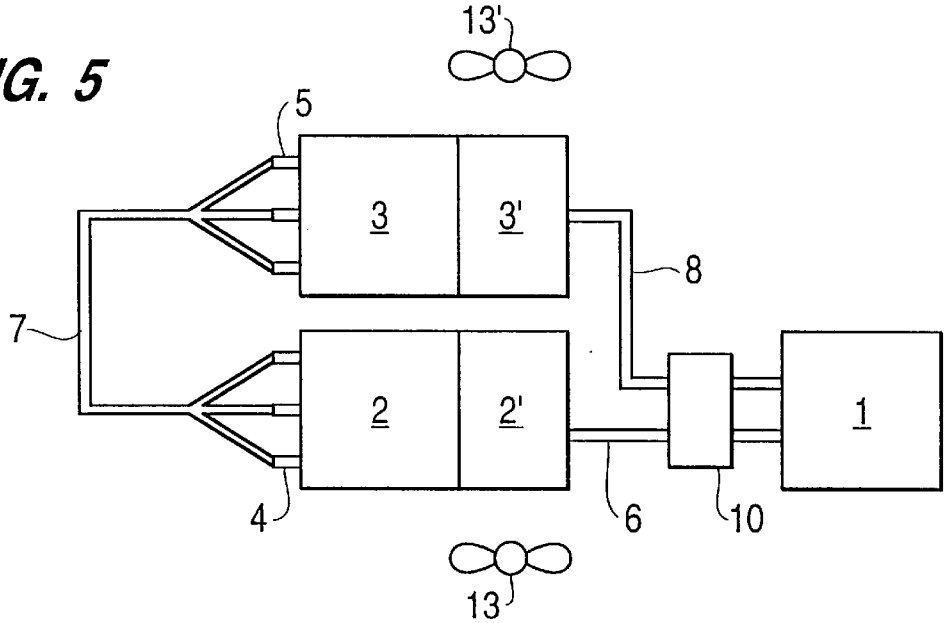
FIG. 5 is a schematic view of a third embodiment of the present invention.

FIG. 5 shows the third embodiment of the present invention, in which two fans 13 and 13' are added to the air conditioner shown in FIG. 2. The fans 13 and 13' are provided near an additional condenser 2' and an additional evaporator 3', respectively. In the figures, like numerals indicate like parts.

A compressor 1 and the additional condenser 2' are connected together by a gas pipe 6 having a four-way valve 10. A primary condenser 2 has capillary tubes 4 connected to capillary tubes 5 of an evaporator 3 by a gas pipe 7. The evaporator 3 is directly connected to the additional evaporator 3'. The additional evaporator 3' is connected to the compressor 1 through a gas pipe 8 in which is interposed the four-way valve 10.

For cooling, the four-way valve 10 directs refrigerant gas discharged from the compressor 1 into the additional condenser 2' through the gas pipe 6. Since the fan 13 is activated in this state, the refrigerant can release heat efficiently in the condenser 2'. The refrigerant then flows into the condenser 2 and is further condensed by releasing heat. The thus condensed refrigerant flows the capillary tubes 4 and the gas pipe 7 into the capillary tubes 5 of the evaporator 3. After being depressurized in the tubes 5, the refrigerant is gasified in the evaporator 3. In this state, the fan 13' is deactivated.

For heating, the four-way valve 10 directs refrigerant gas discharged from the compressor 1 into the additional evaporator 3' through the gas pipe 8. Since the fan 13' is activated in this state, the refrigerant can release heat efficiently in the evaporator 3'. The refrigerant then flows into the evaporator 3 and is further condensed by releasing heat. The thus condensed refrigerant flows the capillary tubes 5 and the gas pipe 7 into the capillary tubes 4 of the condenser 2. After being depressurized in the tubes 4, the refrigerant is gasified in the condenser 2. The refrigerant then flows through the condenser 2' and the gas pipe 6 back into the compressor 1.

EXAMPLE

Example is a modified heat pump type air conditioner which was originally operated by use of HCFC (hydrochlorofluorocarbon) 22 as refrigerant gas.

This air conditioner had a compressor having a power of 5.5 Kw (three-phase 200 V, 7.5 HP), and an outdoor unit or condenser and an indoor unit or evaporator both having a heat exchange power of 18750 Kcal/h.

During cooling, refrigerant gas discharged from the compressor is condensed in the condenser as the outdoor unit, fed through a gas pipe into the capillary tubes of the evaporator as the indoor unit, depressurized therein, evaporated in the evaporator, and fed back into the compressor.

During heating, the four-way valve directs refrigerant gas discharged from the compressor into the evaporator as the indoor unit. As a condenser, the evaporator condenses refrigerant. The thus condensed refrigerant flows through the gas pipe into the capillary tubes of the condenser as the outdoor unit, where it is depressurized. Refrigerant is then evaporated in the evaporator and returns into the compressor.

From this conventional air conditioner, refrigerant gas HCFC 22 was drained, and two condensers having a heat exchange capacity of 5000 Kcal/h were connected to the gas circuit connecting the condenser in the outdoor unit to the evaporator in the indoor unit.

With this arrangement, refrigerant condensed in the ordinary condenser is further condensed in the two additional condensers.

The two additional condensers were mounted in juxtaposition with the air suction side of the existing condenser (outdoor unit) so that atmospheric air passes first through the additional condensers and then through the existing condenser.

The combined heat exchange capacity of the two additional condensers was 10000 Kcal/h, which was about 53% of the heat exchange capacity of the existing condenser.

As a refrigerant, new substitute refrigerant gas HFC (hydrofluorocarbon) 134a was used.

During cooling, refrigerant discharged from the compressor is condensed in the existing condenser and then in the two additional condensers, depressurized in the capillary tubes of the evaporator in the indoor unit, evaporated in the evaporator, thus cooling the room, and returned into the compressor.

During heating, the four-way valve directs refrigerant discharged from the compressor into the evaporator in the indoor unit. In the evaporator and the two additional condensers, refrigerant is completely condensed while releasing heat. The condensed refrigerant is then depressurized in the capillary tubes of the condenser in the outdoor unit, evaporated in the condenser, absorbing heat, and returns into the compressor.

Thus, the additional condensers are used as condensers both during cooling and heating.

Measurement data when the modified heat pump type air conditioner was operated using new substitute refrigerant HFC134a are shown below (temperature in °C., and pressure in Kg/cm$^2$)

Cooling Operation 1. atmospheric air temp . . . 30.7
2. compressor head temp . . . 46.3
3. gas temp at compressor outlet . . . 69.3
4. gas temp at existing condenser inlet . . . 67.7
5. gas temp at existing condenser outlet . . . 41.3
6. gas temp at additional condenser inlet . . . 41.4
7. gas temp at additional condenser outlet . . . 33.5
8. gas temp at evaporator capillary tube inlet . . . 33.4
9. gas temp at evaporator inlet . . . 10.3
10. gas temp at evaporator outlet . . . 7.9
11. gas temp at compressor inlet . . . 8.3
12. atmospheric air temp at additional condenser inlet . . . 30.3
13. atmospheric air temp at additional condenser outlet . . . 34.2
14. atmospheric air temp at existing condenser inlet . . . 34.2
15. atmospheric air temp at existing condenser outlet . . . 46.3
16. atmospheric air temp at evaporator inlet . . . 20.6
17. atmospheric air temp at evaporator outlet . . . 9.1
18. room center temp . . . 22.3
19. condenser side gas pressure . . . 8.5
20. evaporator side gas pressure . . . 1.6
21. R-phase current (A) . . . 14.6
22. S-phase current (A) . . . 13.1
23. T-phase current (A) . . . 14.5

Heating Operation 1. atmospheric air temp . . . 9.3
2. compressor head temp . . . 42.2
3. gas temp at compressor outlet . . . 62.8
4. gas temp at indoor evaporator inlet . . . 62.8
5. gas temp at indoor evaporator outlet . . . 36.2
6. gas temp at outdoor additional condenser inlet . . . 36.0
7. gas temp at outdoor additional condenser outlet . . . 27.6
8. gas temp at outdoor existing condenser capillary tube inlet . . . 27.6
9. gas temp at outdoor condenser inlet . . . (structurally unmeasurable)
10. gas temp at outdoor condenser outlet . . . 11.5
11. gas temp at compressor inlet . . . 10.5
12. atmospheric air temp at indoor evaporator inlet . . . 16.8
13. atmospheric air temp at indoor evaporator outlet . . . 38.1
14. atmospheric air temp at outdoor additional condenser inlet . . . 9.2
15. atmospheric air temp at outdoor additional condenser outlet . . . 15.3
16. atmospheric air temp at outdoor existing condenser inlet . . . 15.3
17. atmospheric air temp at outdoor existing condenser outlet . . . 6.7
18. room center temp . . . 15.2
19. condenser side gas pressure . . . 9.8
20. evaporator gas pressure . . . 5.8
21. R-phase current (A) . . . 13.6
22. S-phase current (A) . . . 12.0
23. T-phase current (A) . . . 13.0

As will be apparent from these data, operation was very good both during cooling and heating.

During heating, the additional condensers reduced the gas temperature by 7.9° C. from 41.4° C. to 33.5° C. Also, air sucked into the additional condensers rose by 3.9° C. from 30.3° C. to 34.2° C. when it left the condensers. This indicates that the refrigerant was condensed sufficiently by releasing heat.

During heating, the additional condensers reduced the gas temperature by 8.4° C. from 36.0° C. to 27.6° C. Also, air sucked into the additional condensers rose by 6.1° C. from 9.2° C. to 15.3° C. when it left the condensers. This indicates that the refrigerant was condensed sufficiently by releasing heat.

Since the additional condensers mounted on the outdoor unit serve as condensers both during cooling and heating, refrigerant can be condensed sufficiently both during cooling and heating and thus completely liquefied. The completely liquefied refrigerant is more compatible with a mineral lubricating oil. This makes it possible to operate a heat pump using new substitute refrigerant gas HFC 134a.

As will be apparent from the above description, the heat pump type air conditioner can be operated using new substitute refrigerant gas HFC (hydrofluorocarbon), which is zero in ozone layer destruction coefficient, nonflammable and nonpoisonous, in combination with a conventional mineral lubricating oil.

By increasing the heat exchange capacity of the condenser by 20–30%, it is possible to completely liquefy HFC134 refrigerant. Completely liquefied HFC134 dissolves well with a mineral lubricating oil.

For an unknown reason, it was found out that the heat exchange capacity can be increased more efficiently by adding a separate condenser having a required heat exchange capacity to an existing condenser than replacing the existing condenser with a big-power condenser. This is an important finding in preventing the destruction of the ozone layer.

In the case of a heat pump type cooling only air conditioner, simply by adding an extra condenser, it is possible to increase the heat exchange capacity. But in the case of a heat pump type cooling/heating air conditioner, no normal operation was possible simply by increasing the heat exchange power of both the condenser and the evaporator.

According to the present invention, the additional heat exchanger (condenser) is used as a condenser both during cooling and heating, or one of the additional condenser and evaporator are selectively used by means of a switch or a valve only when it works as a condenser. With this arrangement, it is possible to completely liquefy new substitute refrigerant gas.

In the embodiments, HFC134a is used as a refrigerant. But HFC125 may be used instead. In such a case, the additional condenser or evaporator has to have a larger heat exchange power than when HFC134a is used. Specifically, it is necessary to increase the heat exchange power by at least 50%, though this figure slightly varies with the operating conditions.

Such an additional condenser or evaporator can be provided on a newly built air conditioner. An existing air conditioner can also be retrofit easily by adding an additional condenser or evaporator in the outdoor unit and slightly changing piping and/or wiring.

Though in this application HFC125 is used as refrigerant gas, this invention is applicable to HCFC gas.

What is claimed is:

1. A heat pump type cooling/heating air conditioner using substitute refrigerant gas HFC and comprising a compressor, a first evaporator having capillary tubes, a first condenser having capillary tubes connected to said capillary tubes of said evaporator, a second evaporator connected directly to said first evaporator, a second condenser connected directly to said first condenser, said compressor connected to said second evaporator and said second condenser through a four-way valve, a first fan for feeding air to said second evaporator, and a second fan for feeding air to said second condenser, said first fan having a switch so that said fan can be deactivated by operating said switch during cooling.

2. A heat pump type cooling/heating air conditioner as claimed in claim 1 wherein said second evaporator has a heat exchange capacity which is 30% or more of the heat exchange capacity of said first evaporator.

3. A heat pump type cooling/heating air conditioner as claimed in claim 1 wherein at least one of said condensers and said evaporators has a gas pipe case including a plurality of gas circuits formed by extrusion molding.

4. A heat pump type cooling/heating air conditioner using a substitute refrigerant gas HFC, said heat pump type cooling/heating air conditioner comprising:

a compressor;

a first condenser connected to said compressor by a gas pipe through a four-way valve, said first condenser being provided with capillary tubes;

a second condenser connected to said capillary tubes of said first condenser by a gas pipe extending between said capillary tubes and said second condenser, wherein said second condenser has a heat exchange capacity which is not less than 20% of a heat exchange capacity of said first condenser; and an evaporator provided with capillary tubes and connected to said second condenser by a gas pipe extending between said capillary tubes and said second condenser, wherein said evaporator and said compressor are connected together by a gas pipe through said four-way valve, thereby changing over cooling and heating operations.

5. A heat pump type cooling/heating air conditioner as claimed in claim 4, wherein said second condenser has a gas pipe circuit having a pipe inner diameter which is 80% or less than the pipe inner diameter of a gas pipe circuit in said first condenser, or having a sectional area which is 64% or less than the sectional area of said gas pipe circuit in said first condenser.

6. A heat pump type cooling/heating air conditioner as claimed in claim 4, wherein said second condenser is mounted to an air sucking side of said first condenser so that atmospheric air first passes through said second condenser and then through said first condenser.

7. A heat pump type cooling/heating air conditioner as claimed in claim 4, wherein said four-way valve is changed over between a cooling operation in which refrigerant gas is discharged from said compressor through said gas pipe into said first condenser, condensed in said first condenser, fed to said second condenser where it is condensed further, then fed into said capillary tubes of said evaporator while being depressurized in said capillary tubes, evaporated in said evaporator, and fed back into said compressor, and a heating operation in which refrigerant gas is discharged from said compressor through said four-way valve into said evaporator, condensed in said evaporator, which is now used as a condenser, fed into said second condenser where it is further condensed, fed into said capillary tubes of said first condenser while being depressurized in said capillary tubes, evaporated in said first condenser, which is now used as an evaporator, and fed back into said compressor, whereby refrigerant gas is condensed while releasing heat in said second condenser both during cooling and heating operations.

8. A heat pump type cooling/heating air conditioner using a substitute refrigerant gas HFC, said heat pump type cooling/heating air conditioner comprising:

a compressor;

a first condenser connected to said compressor by a gas pipe through a four-way valve, said first condenser being provided with capillary tubes;

a second condenser connected to said capillary tubes of said first condenser by a gas pipe extending between said capillary tubes and said second condenser; and an evaporator provided with capillary tubes and connected to said second condenser by a gas pipe extending between said capillary tubes and said second condenser, wherein said evaporator and said compressor are connected together by a gas pipe through said four-way valve, thereby changing over cooling and heating operations, and wherein said second condenser has a gas pipe circuit having a pipe inner diameter which is 80% or less than a pipe inner diameter of a gas pipe circuit in said first condenser, or having a sectional area which is 64% or less than the sectional area of said gas pipe circuit in said first condenser.

9. A heat pump type cooling/heating air conditioner as claimed in claim 8, wherein said second condenser is mounted to an air sucking side of said first condenser so that atmospheric air first passes through said second condenser and then through said first condenser.

10. A heat pump type cooling/heating air conditioner as claimed in claim 8, wherein said four-way valve is changed over between a cooling operation in which refrigerant gas is discharged from said compressor through said gas pipe into said first condenser, condensed in said first condenser, fed to said second condenser where it is condensed further, then fed into said capillary tubes of said evaporator while being depressurized in said capillary tubes, evaporated in said evaporator, and fed back into said compressor, and a heating operation in which refrigerant gas is discharged from said compressor through said four-way valve into said evaporator, condensed in said evaporator, which is now used as a condenser, fed into said second condenser where it is further condensed, fed into said capillary tubes of said first condenser while being depressurized in said capillary tubes, evaporated in said first condenser, which is now used as an evaporator, and fed back into said compressor, whereby refrigerant gas is condensed while releasing heat in said second condenser both during cooling and heating operations.

11. A heat pump type cooling/heating air conditioner using a substitute refrigerant gas HFC, said heat pump type cooling/heating air conditioner comprising:

a compressor;

a first condenser connected to said compressor by a gas pipe through a four-way valve, said first condenser being provided with capillary tubes;

a second condenser connected to said capillary tubes of said first condenser by a gas pipe extending between said capillary tubes and said second condenser; and an evaporator provided with capillary tubes and connected to said second condenser by a gas pipe extending between said capillary tubes and said second condenser, wherein said evaporator and said compressor are connected together by a gas pipe through said four-way valve, thereby changing over cooling and heating operations, and wherein said second condenser is mounted to an air sucking side of said first condenser so that atmospheric air first passes through said second condenser and then through said first condenser.

12. A heat pump type cooling/heating air conditioner as claimed in claim 11, wherein said four-way valve is changed over between a cooling operation in which refrigerant gas is discharged from said compressor through said gas pipe into said first condenser, condensed in said first condenser, fed to said second condenser where it is condensed further, then fed into said capillary tubes of said evaporator while being depressurized in said capillary tubes, evaporated in said evaporator, and fed back into said compressor, and a heating operation in which refrigerant gas is discharged from said compressor through said four-way valve into said evaporator, condensed in said evaporator, which is now used as a condenser, fed into said second condenser where it is further condensed, fed into said capillary tubes of said first condenser while being depressurized in said capillary tubes, evaporated in said first condenser, which is now used as an evaporator, and fed back into said compressor, whereby refrigerant gas is condensed while releasing heat in said second condenser both during cooling and heating operations.

13. A heat pump type cooling/heating air conditioner using a substitute refrigerant gas HFC, said heat pump type cooling/heating air conditioner comprising:

a first evaporator having capillary tubes;

a first condenser having capillary tubes connected to said capillary tubes of said first evaporator;

a second evaporator connected to said first evaporator;

a second condenser connected to said first condenser;

a compressor connected to said second evaporator and said second condenser through a four-way valve;

a bypass line connecting said compressor to said first evaporator while bypassing said second evaporator; and a changeover means for feeding refrigerant from said first evaporator to said four-way valve through said bypass line and from said four-way valve to said first evaporator through said second evaporator, wherein said second evaporator has a heat exchange capacity which is 30% or more of a heat exchange capacity of said first evaporator.

14. A heat pump type cooling/heating air conditioner using a substitute refrigerant gas HFC, said heat pump type cooling/heating air conditioner comprising:

a first evaporator having capillary tubes;

a first condenser having capillary tubes connected to said capillary tubes of said first evaporator;

a second evaporator connected to said first evaporator;

a second condenser connected to said first condenser;

a compressor connected to said second evaporator and said second condenser through a four-way valve;

a bypass line connecting said compressor to said first evaporator while bypassing said second evaporator; and a changeover means for feeding refrigerant from said first evaporator to said four-way valve through said bypass line and from said four-way valve to said first evaporator through said second evaporator, wherein at least one of said condensers and said evaporators has a gas pipe case including a plurality of gas circuits formed by extrusion molding.

* * * * *